US012006778B2

(12) United States Patent
Banks et al.

(10) Patent No.: US 12,006,778 B2
(45) Date of Patent: Jun. 11, 2024

(54) NON-ROTATING DRILL PIPE PROTECTOR TOOL HAVING MULTIPLE TYPES OF HYDRAULIC BEARINGS

(71) Applicant: WWT NORTH AMERICA HOLDINGS, INC., Houston, TX (US)

(72) Inventors: Sarah Banks, Fullerton, CA (US); Norman Bruce Moore, Aliso Viejo, CA (US)

(73) Assignee: WWT North America Holdings, Inc., Houston, TX (US)

( * ) Notice: Subject to any disclaimer, the term of this patent is extended or adjusted under 35 U.S.C. 154(b) by 0 days.

(21) Appl. No.: 17/931,274

(22) Filed: Sep. 12, 2022

(65) Prior Publication Data

US 2023/0087579 A1 Mar. 23, 2023

Related U.S. Application Data

(60) Provisional application No. 63/261,551, filed on Sep. 23, 2021.

(51) Int. Cl.
*E21B 17/10* (2006.01)

(52) U.S. Cl.
CPC ..... *E21B 17/1007* (2013.01)

(58) Field of Classification Search
CPC .... E21B 17/105; E21B 17/1042; E21B 17/10; E21B 17/1064; E21B 17/1057
See application file for complete search history.

(56) References Cited

U.S. PATENT DOCUMENTS

| | | | | |
|---|---|---|---|---|
| 1,764,769 | A | 6/1930 | Woods | |
| 2,572,307 | A | 10/1951 | Brown et al. | |
| 2,589,534 | A | 3/1952 | Buttolph | |
| 2,715,552 | A | 8/1955 | Lane | |
| 3,063,760 | A * | 11/1962 | Gifford | E21B 17/1042 175/325.5 |
| 3,193,918 | A | 7/1965 | Heldenbrand | |
| 3,268,275 | A | 8/1966 | Laughlin | |
| 3,322,217 | A | 5/1967 | Cook | |
| 3,484,141 | A * | 12/1969 | Collett | E21B 17/105 166/176 |
| 3,747,700 | A | 7/1973 | Rilling | |
| 3,784,238 | A | 1/1974 | Chance et al. | |

(Continued)

FOREIGN PATENT DOCUMENTS

| | | |
|---|---|---|
| CA | 2330963 A1 | 11/1999 |
| CA | 3020756 A1 | 10/2017 |

(Continued)

OTHER PUBLICATIONS

International Search Report and Written Opinion for PCT/US2022/076308, dated Dec. 20, 2022, 13 pages.

(Continued)

*Primary Examiner* — Kipp C Wallace
(74) *Attorney, Agent, or Firm* — Lewis Roca Rothgerber Christie LLP

(57) ABSTRACT

A non-rotating drill pipe protector comprising a collar for attachment to a drill pipe and a sleeve positioned around the collar wherein drilling fluid passing between flexible bearing surfaces between the collar and the sleeve generate hydrodynamic bearings in both an axial and thrust direction of the drill pipe.

19 Claims, 5 Drawing Sheets

(56) References Cited

U.S. PATENT DOCUMENTS

| | | | | |
|---|---|---|---|---|
| 4,146,060 | A | 3/1979 | Garrett | |
| 4,434,125 | A | 2/1984 | Lavender et al. | |
| 4,762,186 | A | 8/1988 | Dech et al. | |
| 4,938,299 | A | 7/1990 | Jelsma | |
| 5,148,876 | A | 9/1992 | Wilson | |
| 5,697,460 | A | 12/1997 | Stewart et al. | |
| 5,901,798 | A | 5/1999 | Herrera et al. | |
| 5,941,312 | A | 8/1999 | Vermeeren | |
| 6,012,744 | A | 1/2000 | Wilson et al. | |
| 6,032,748 | A | 3/2000 | DeBray et al. | |
| 6,655,477 | B2 | 12/2003 | Appleton et al. | |
| 6,688,409 | B1 * | 2/2004 | Murray | E21B 17/1057 166/241.1 |
| 7,392,861 | B2 | 7/2008 | Fouillou et al. | |
| 7,409,758 | B2 | 8/2008 | Le et al. | |
| 7,412,761 | B2 | 8/2008 | Male et al. | |
| 7,814,996 | B2 | 10/2010 | Indrupskiy et al. | |
| 8,119,047 | B2 | 2/2012 | Moore et al. | |
| 8,511,377 | B2 | 8/2013 | Casassa et al. | |
| 8,668,007 | B2 | 3/2014 | Casassa et al. | |
| 9,328,568 | B2 | 5/2016 | Andrigo | |
| 9,957,758 | B2 * | 5/2018 | Boulet | E21B 17/1064 |
| 10,619,427 | B2 | 4/2020 | Gaskins | |
| 10,710,325 | B2 * | 7/2020 | Olah | B32B 3/266 |
| 10,920,909 | B2 * | 2/2021 | Connors | F16L 1/11 |
| 2002/0129976 | A1 * | 9/2002 | Rastegar | E21B 17/1064 175/323 |
| 2003/0106719 | A1 | 6/2003 | Herrera | |
| 2003/0192720 | A1 * | 10/2003 | Mitchell | E21B 41/0078 175/325.5 |
| 2008/0217063 | A1 * | 9/2008 | Moore | E21B 17/12 175/57 |
| 2009/0183869 | A1 | 7/2009 | Davison | |
| 2011/0017516 | A1 | 1/2011 | Gollmyer et al. | |
| 2011/0114307 | A1 | 5/2011 | Casassa et al. | |
| 2011/0114338 | A1 * | 5/2011 | Casassa | E21B 17/1078 166/241.1 |
| 2012/0125689 | A1 * | 5/2012 | Howlett | E21B 17/1085 175/57 |
| 2014/0151026 | A1 | 6/2014 | Andrigo | |
| 2016/0130886 | A1 * | 5/2016 | Simpson | E21B 17/1085 166/380 |
| 2017/0030151 | A1 * | 2/2017 | Lutgring | E21B 17/1064 |
| 2017/0246778 | A1 * | 8/2017 | Trowbridge | B29C 45/14065 |
| 2017/0275956 | A1 | 9/2017 | Palmer | |
| 2018/0112472 | A1 | 4/2018 | Gaskins | |
| 2019/0040693 | A1 | 2/2019 | Smith et al. | |
| 2019/0284883 | A1 | 9/2019 | Banks et al. | |
| 2020/0158206 | A1 | 5/2020 | Banks | |
| 2020/0165881 | A1 | 5/2020 | Nommensen | |
| 2021/0079740 | A1 | 3/2021 | Baynham et al. | |
| 2022/0298872 | A1 * | 9/2022 | Smith | E21B 17/1064 |

FOREIGN PATENT DOCUMENTS

| | | | |
|---|---|---|---|
| CA | 3035407 | A1 | 9/2019 |
| CN | 2378530 | Y | 5/2000 |
| CN | 204984297 | U | 1/2016 |
| DE | 497705 | C | 5/1930 |
| GB | 2338970 | A | 12/2000 |
| WO | 2015026243 | A2 | 2/2015 |

OTHER PUBLICATIONS

Canadian Office action for Application No. 3,035,407, dated Jan. 28, 2022, 11 pages.

Canadian First Office action for Application No. 3,035,407, dated Jul. 14, 2020, 4 pages.

Schlumberger, "Sub", undated, https://glossary.oilfield.slb.com/en/terms/s/sub, 2 pages (Year: 2021).

International Preliminary Report of Patentability and Written Opinion for PCT/US2022/076308, dated Mar. 26, 2024, 8 pages.

* cited by examiner

NON-ROTATING DRILL PIPE PROTECTOR TOOL HAVING MULTIPLE TYPES OF HYDRAULIC BEARINGS

CROSS-REFERENCE TO RELATED APPLICATION

This application claims priority and the benefit of U.S. Provisional Application No. 63/261,551, filed on Sep. 23, 2021, the entire content of which are hereby incorporated by reference herein in its entirety.

BACKGROUND OF THE INVENTION

Non-rotating protector (NRP) is a commonly used name for a bearing tool used on drill strings in drilling oil, gas, and geothermal wells. NRPs are attached to an outside surface of a drill pipe by mechanical means, including bolts or pins, bonding with adhesives, or retained through other means. NRPs allow the drill pipe to rotate within the NRP bearing. The NRP bearing body (herein referred to as a sleeve or bearing sleeve) does not rotate relative to the drill pipe or rotates at a small percentage of the drill pipe rotational speed.

Reducing rotational contact with the wellbore prevents wear to the drill pipe and pressure containment casing within the wellbore. NRPs may also contain means to reducing rotational and sometimes axial friction compared to that of the drill pipe against the wellbore. The end goal is to help drilling companies maintain wellbore structural and pressure integrity by preventing wear, and to facilitate the efficient transfer of torque from the surface to the drill bit at the bottom of the wellbore.

These NRP bearings must operate at substantial radial and thrust loads when drilling ahead in a downhole environment in a variety of fluids and temperatures. Radial loads more than 2000-lbf to 15000-lbf or more are possible.

Prior NRPs utilizes a hydrodynamic bearing to reduce rotational friction caused by radial loads. Current NRP designs utilize various low-friction materials to minimize friction caused by radial loads. Low friction materials offer modest rotational friction reduction in the radial direction, but hydrodynamic bearings offer substantial rotational friction reduction in the radial direction, often reducing the rotational friction by 50-90%.

In the above cases, there is still substantial torsional friction generated by the thrust loads acting on the bearing as the drill pipe progresses downhole during drilling. With effective radial friction reduction, thrust loads constitute up to 50% of the overall rotational friction at the NRP, and represent the main cause of wear. This wear limits the useful life of a protector in most cases, and greatly affects the durability of the protector and therefore economic performance of the protector.

Prior clamp-on type protectors have limits to thrust loads (on the assembly) before the assembly slips on the drill pipe. The slip load is affected by the make-up torque of its bolts, surface characteristics of the clamp-on collar and the drill pipe, and collar flexural rigidity. Slip loads for two collars supporting a sleeve can range from 15,000 to 30,000-lbs. However, the increasing use of Managed Pressure Drilling utilizing Rotating Control Heads (RCH) that a NRP must pass through, higher collar gripping loads are highly desirable. Consequently, a need exists for an improved non-rotating drill pipe protector that addresses the drawbacks of existing NRPs and achieves higher gripping loads and improved performance.

SUMMARY OF THE INVENTION

The present invention is a non-rotating drill pipe protector (NRP) that addresses the limitations of friction from high thrust loads on NRPs with a "fluid bearing" type of thrust bearing and increases the resistance to slipping of collars. The invention is directed to a Non-Rotating Protector that incorporates multiple types of hydrodynamic bearings that act in both the radial and thrust direction by means of flexible bearing surfaces and drilling or intervention fluids.

The invention consists of a collar and a sleeve. The collar typically consists of two halves, which facilitate installation. Similarly, the sleeve typically consists of two halves. The collar includes multiple (3-12) circumferential rings with an external diameter that is smaller than a drill pipe tool joint diameter. The sleeve has circumferential grooves designed to fit radially over the collar's circumferential rings. When placed on drill pipe downhole while circulating drilling mud, multiple hydrodynamic fluid bearings are created within the NRP assembly in both the circumferential and axial directions. These and other aspects, improvements and advantages of the invention will be more understood by reference to the drawing and detailed description herein.

DETAILED DESCRIPTION

Figure 1:
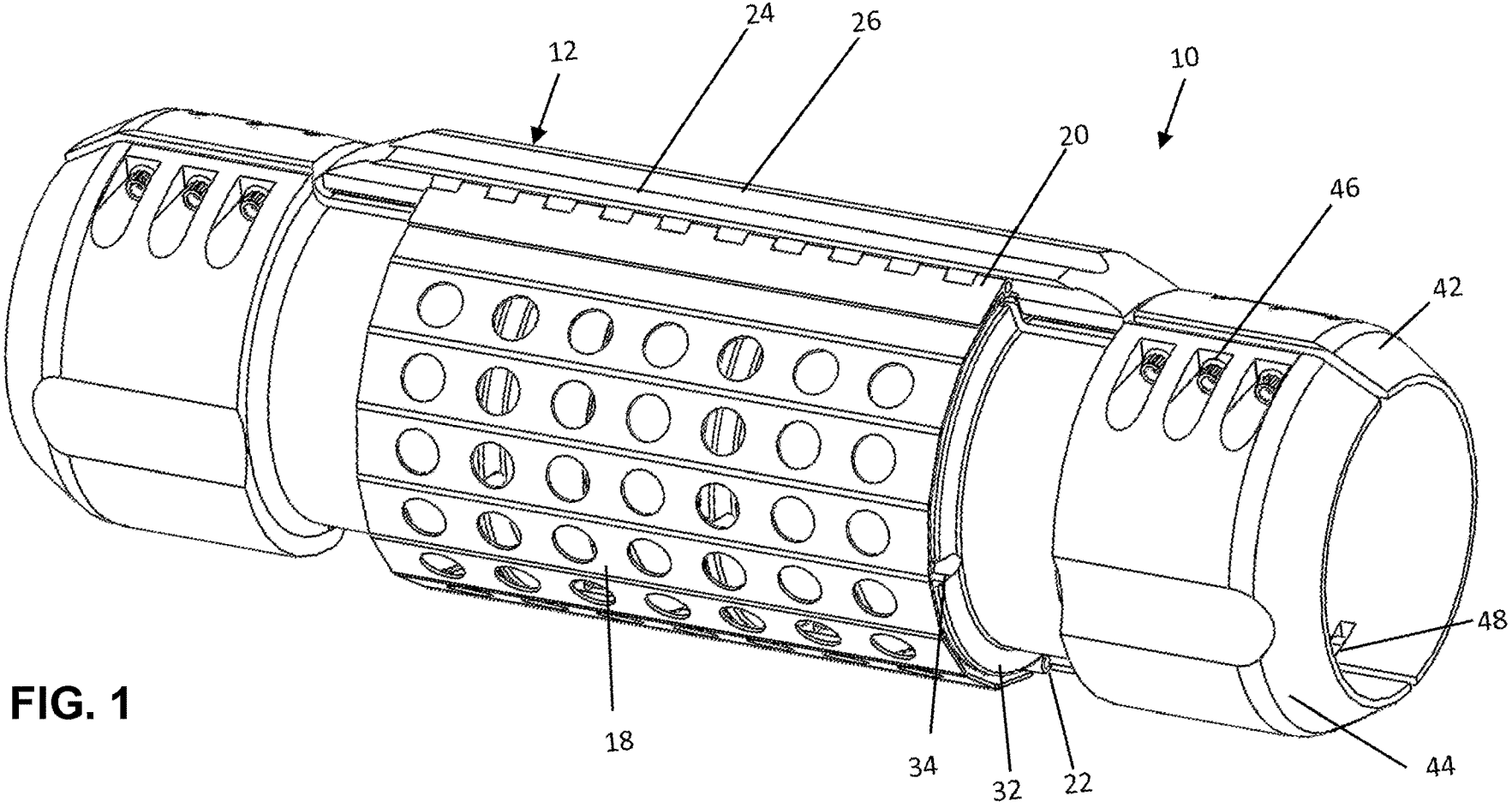
FIG. 1 is a perspective and partially cutaway view of the NRP of the present invention with multiple types of hydraulic bearings.
Figure 2:
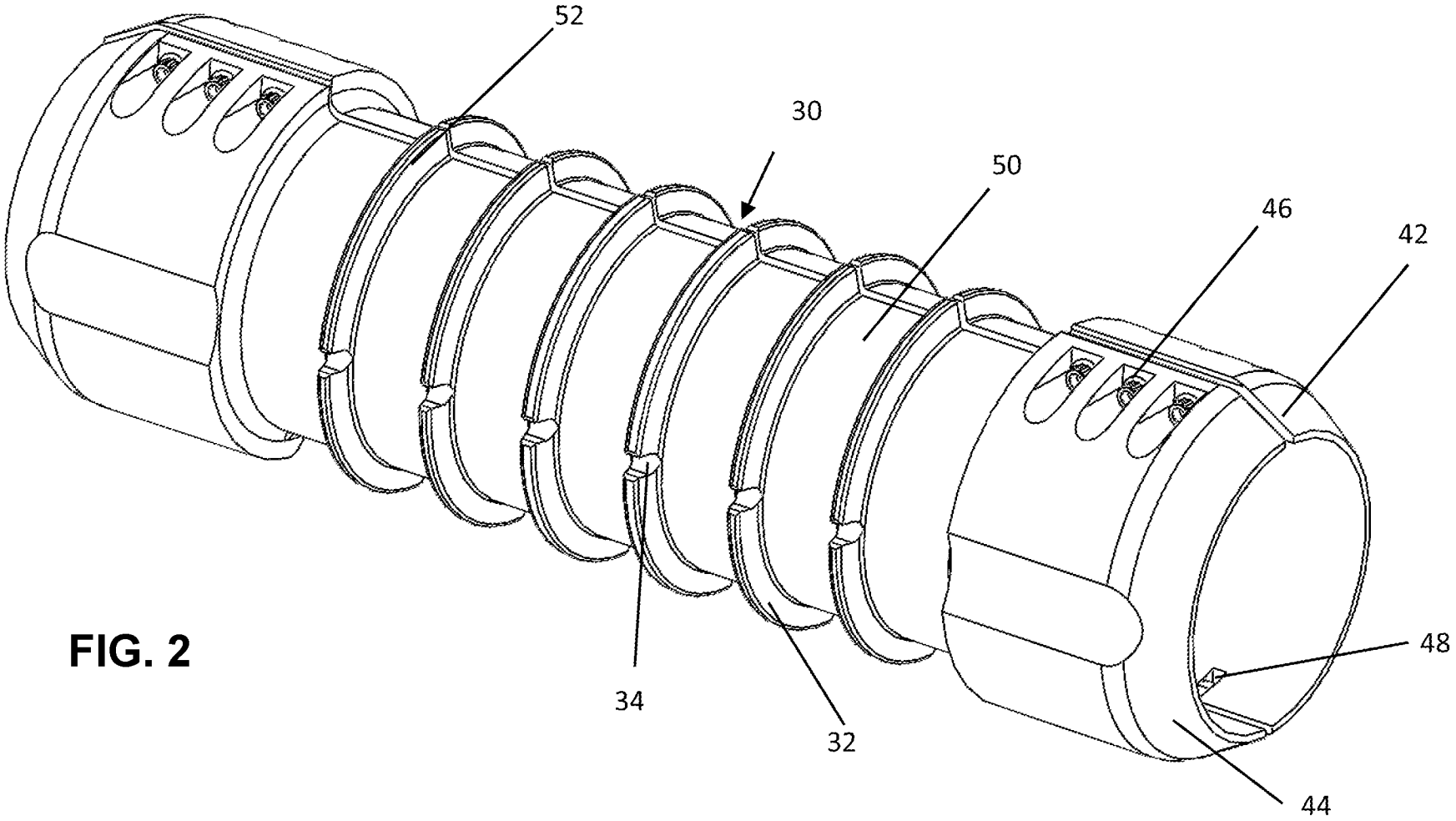
FIG. 2 is a perspective view of an embodiment of a collar for the NRP of FIG. 1 with multiple fluid bearings.
Figure 3:
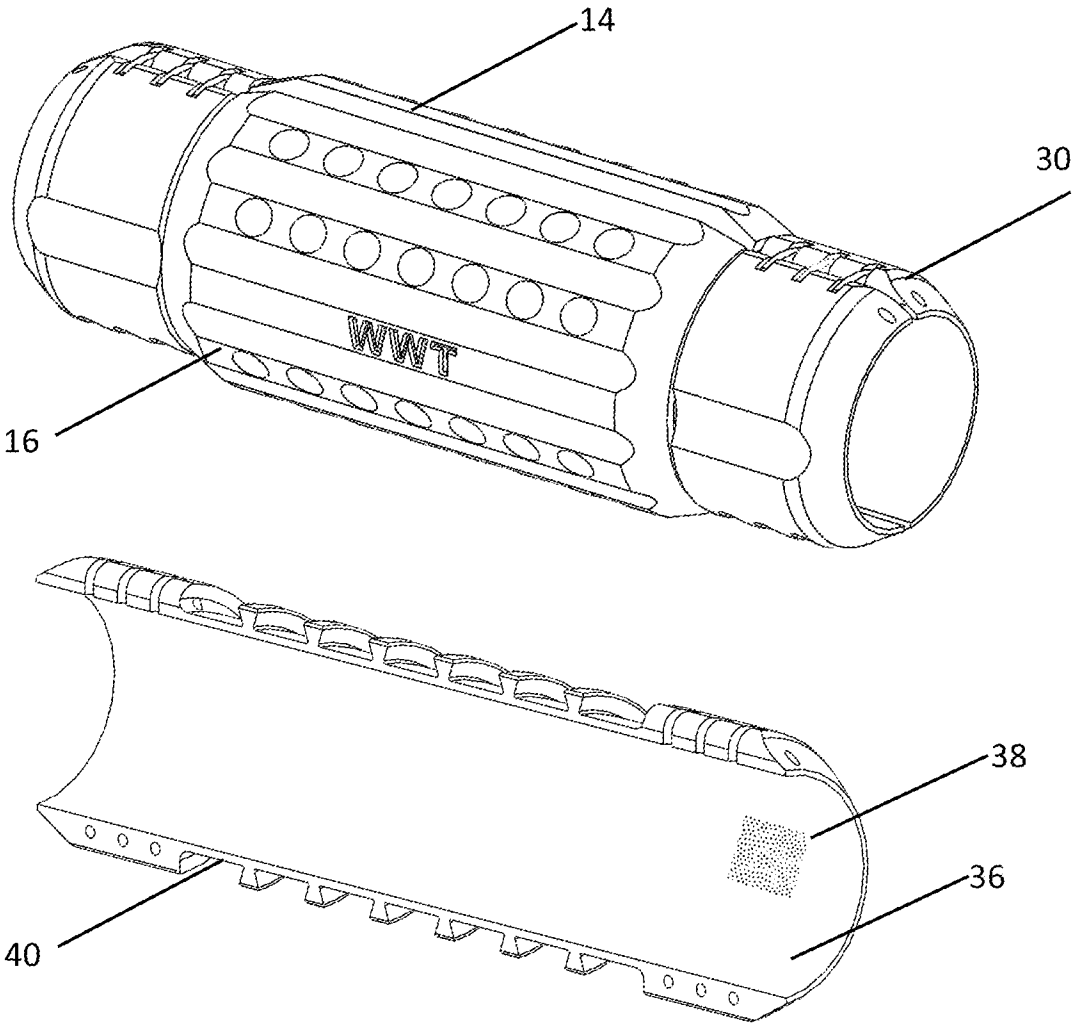
FIG. 3 is a perspective view of an alternative embodiment collar and sleeve with multiple fluid bearings having trapezoidal thrust bearing rings and corresponding circumferential grooves in the sleeve.

FIG. 1 illustrates an isometric partially cutaway view of a NRP 10 of the present invention with multiple types of hydraulic bearings. The NRP includes a sleeve 12 comprising two sleeve halves 14, 16 (FIG. 3). Embedded within the sleeve is an internal metal (typically steel) structural cage 18 also formed in two halves including a sleeve cage hinge 20 for connection of the halves at one side, and a pin 22 for connection of the halves at an opposite side. As shown in FIGS. 2 and 3, the sleeve 12 is positioned around a collar 30 having multiple thrust bearing rings 32, each having fluid flow channels or grooves 34.

The exterior of the sleeve 12 may have either straight blades 24 and large flutes 26 or spiral blades as disclosed in Applicant's U.S. Pat. No. 8,511,377 the disclosure of which is incorporated herein by reference. The straight blades help prevent the sleeve from rotating; the large flutes facilitate flow by of the returning well bore fluid, thereby reducing an equivalent circulating density (ECD). Lower ECD thereby improves drilling rates and helps to control "kicks" that present safety hazards. Spiral blades facilitate traversing from casing into open hole. Further, by making the diameter of the sleeve greater than the diameter to the drill pipe it is attached to produces a "standoff" preventing the drill pipe from wearing the casing.

The NRP 10 can be placed strategically (typically based on calculation of side load of the drill pipe against the casing) in a drill string with drilling analyses, protecting select areas from high drill pipe side loads that results in high drilling torque and casing wear. The NRP has a relatively low weight, less than 20 lb. per assembly, which facilitates ease and speed of installation (less than 60 seconds) on the drill rig. Further, the light weight of the invention has negligible effect on the total rig load capacity, which for some applications offshore is critical to the safety of the operation. The NRP 10 has ease of manufacture with a collar made of extrusions that close match final form.

The inside surface 36 of the collar can be treated with deformable materials (zinc, aluminum, or a combination therein) that increase gripping to the drill pipe, or coated with high friction materials 38 that often contain hard particles or grit. The outside surface 40 of the collar can be coated with spray on materials (steel, zinc, polymers) that improve its resistance to drilling fluids. The sleeve or collar can be replaced separately, thereby preventing waste for partially used parts. A further detailed description of the NRP is describe below.

Bearing Collar

The collar 30 is manufactured in two or more pieces 42, 44 and is bolted to the drill pipe with high strength bolts 46. Fluid bearings are created radially and axially with drilling fluid between the collar 30 and the sleeve 12. For the axial fluid bearing, multiple (1-12) circumferential bearing rings 32 (preferably between 4-8) with an external diameter that is smaller than the drill pipe tool joint (connection) diameter are separated from the sleeve producing the fluid bearing. FIG. 2 shows one embodiment of a collar 30 for the NRP with multiple fluid bearings. The collar, in this embodiment illustrating two halves are connected by a collar hinge 48. Rotational hydrodynamic fluid bearings are created in the flat surfaces 50 between the circumferential thrust bearing rings 32. Axial fluid bearings are created on multiple exterior bearing 52 surfaces on the thrust bearing rings 32.

The circumferential bearing rings 32 providing the hydrodynamic axial bearings are located within the radial hydrodynamic bearing and have a total projected area that is 50% to 200% of the radial bearing projected area. This substantially increases the contact area available for lubrication between the non-rotating sleeve and rotating collar.

The thrust bearing rings may have a square (FIG. 1), tapered (FIG. 2), or dovetail (FIG. 3) shaped cross-section. FIG. 3 shows a dovetail configuration that is a trapezoidal cross section, with the angle set at 45° to 135° (preferably between 70° and 110°) relative to the rotational axis of the drill pipe. The bearing rings 32 may be symmetrical, or in a 'buttress' profile that biases in the uphole or downhole direction. In all these cases, the rings provide an axial hydrodynamic bearing component, with the cylindrical sections between the rings providing the radial hydrodynamic bearing component.

FIG. 3 illustrates an embodiment of a collar and sleeve with multiple fluid bearings that uses trapezoidal thrust bearing rings and corresponding circumferential grooves in the sleeve (upper). In the case of the 'dove tail' profile for the thrust bearing rings, the embodiment geometry can serve to mechanically lock the bearing sleeve onto the collar, providing additional tenacity and strength, perhaps negating the need for an internal reinforcing structure within the bearing sleeve.

The circumferential bearing rings may have the same or different angle orientation relative to the longitudinal axis of the assembly. In one embodiment, the circumferential rings have the same angle orientation on both sides. In this embodiment the circumferential grooves allow the sleeve to be inverted if one end is excessively worn, thereby increasing the useful life of the replaceable sacrificial sleeve. Alternatively, one ring would have flanks with an orientation of 90 degrees relative to the longitudinal axis, while an adjacent ring could have a trapezoidal shape with orientation of 75 degrees relative to the axis. The fluid-flow channels or grooves 34 are continuously at the same angle orientation but alternatively may be multi-segments of different orientation, which is advantages for some drilling fluids.

The circumferential bearing rings 32 have multiple longitudinal channels or grooves 34 as shown in FIG. 2. The channels or grooves have multiple purposes including allowing drilling fluid to enter the interior between the collar and the sleeve, and to facilitate assembly of the collar segments with (typically 2) or more side hinges 48. The circumferential bearing rings are spaced to allow an effective radial fluid bearing to be formed between them. The longitudinal grooves 34 allow fluid to flow axially within the sleeve for lubrication and may be staggard circumferentially to "trap" or retain fluid at the surfaces of relative motion within the bearing. This circuitous path also damps vibration by reducing leakage should the bearing surfaces have a sudden change of force (impulse).

The number of spaces 50 between circumferential rings and size of the spaces (length for a particular diameter of drill pipe) are designed to allow formation of a fluid bearing. It is important to note that the relative length of the spaces between the circumferential rings is not necessarily equidistant. For example, experimental results show that if circumferential wear occurs it is most like on the first and last of the spaces between the rings; hence, greater spacing between the first and second circumferential rings and last and next to last circumferential rings can be advantageous for improved wear life. In addition, the thickness of the collar between circumferential rings can be varied to address wear, which may occur when excessive cuttings are in the returning annular fluid. It can be advantageous to have greater collar thickness between the first and second circumferential ring and the last and next to last circumferential rings, for example. Both the spacing between the circumferential rings and the thickness of the collar at those respective rings can be optimized for maximized fluid bearing performance and operational life for both the axial thrust and radial bearings. Depending upon the type of drilling fluid the resulting fluid bearing coefficient of friction is typically between 0.02-0.1. As a reference, a low friction material bearing to a metal surface will have a coefficient of friction of 0.1-0.4. This difference is of great significance in overall friction reduction when multiple (100-500) assemblies are attached to a long drill string.

It is important to note that when an axial thrust fluid bearing is overloaded resulting in collapse of the fluid bearing, the invention provides results because of the production of multiple conventional lubricated thrust bearings. Therefore, the NRP of this invention produces a bearing that is superior to a conventional bearing.

Figure 4:
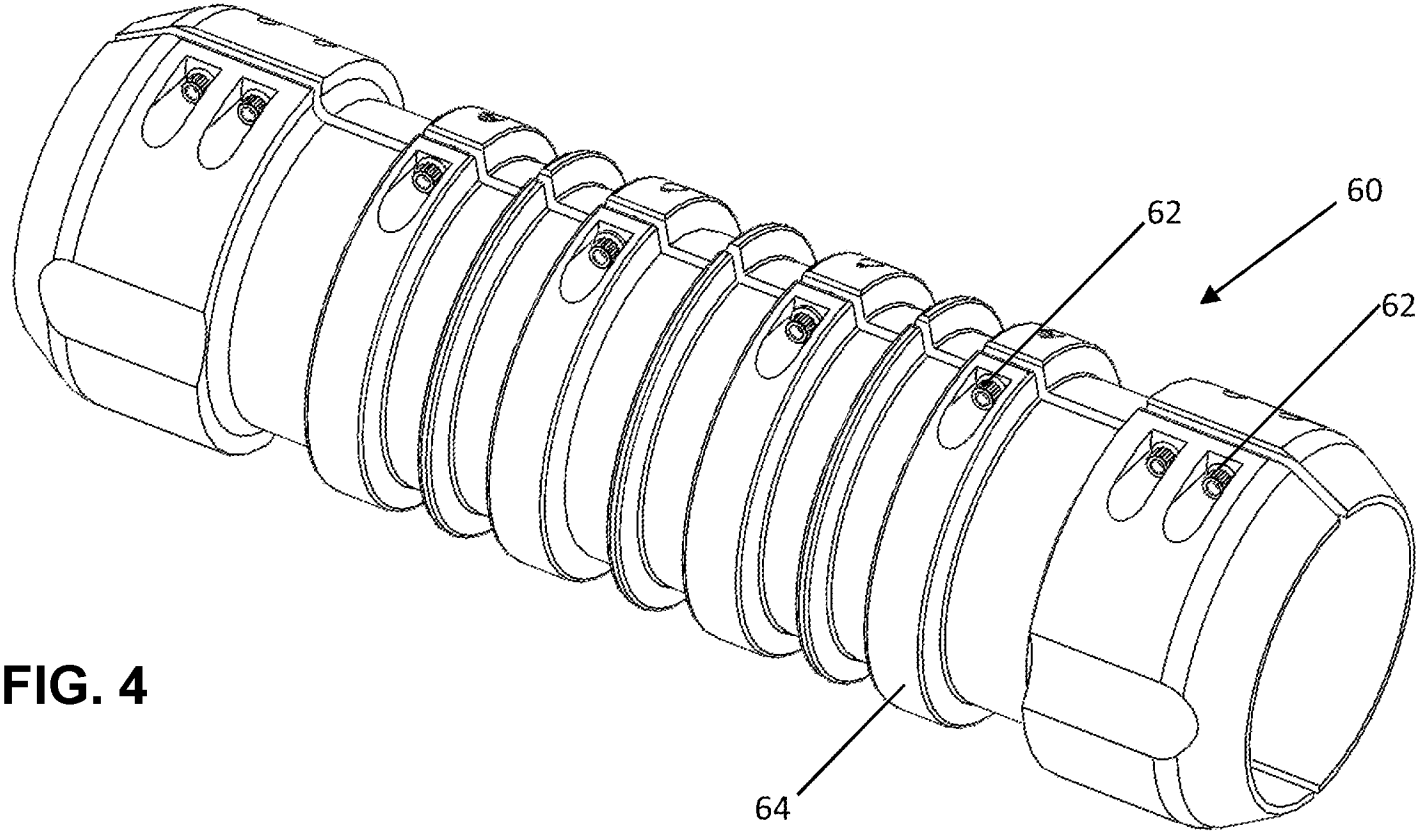
FIG. 4 is a perspective view of another alternative embodiment collar including bolts in the thrust bearing rings.

FIG. 4 illustrates an alternative embodiment collar 60 with fastening bolts 62 in some the thrust bearing rings 64. These circumferential bearing rings 64 including bolts 62 for fastening the collar 60 around the drill pipe increase collar grip onto the pipe. For example, the bolts that can be tightened (to specified torque) thereby increasing the number of gripping points and distributing the gripping.

A feature of the collar assembly is that typically the two collar halves are in contact at their respective ends thereby improving gripping. When two collars do not butt against each other (or are separated by a flexible element such as an unsupported sleeve) it is possible when stripping through a managed pressure drilling (MPD) rotating control device (RCD) element to slip one collar, resulting in damage to the sleeve and prevents its passage into or out of the well. However, in the existing embodiments of the present invention, loads on a one collar half are efficiency shared with the other collar half, doubling the resistance to slipping and preventing load transfer to the sleeve.

As previously indicated the bearing collar may be constructed of multiple segments. In an embodiment, the bearing collar consists to two longitudinal halves that are hinged on one side and pinned by fasteners 46 on the other resulting in a single collar. The advantage of this embodiment is ease of installation and pipe gripping. Alternatively, the bearing collar may also be made of four longitudinal segments with each two being hinged and pinned resulting in two separate collars. During installation the parts are juxtapose to each other allowing axial loads to be shared by both. This alternative also allows the longitudinal grooves to be misaligned thereby facilitating trapping fluid within the bearing assembly for a lower-friction fluid bearing and reduced fluid leakage should the bearing assembly pass through a sealing element. The collar can be constructed from metal, such as aluminum or steel, or composites of glass or carbon.

Bearing Sleeve

The sleeve 12 contains an inside surface geometry 70 including a hydrodynamic radial bearing surface geometry 72 and hydrodynamic (fluid) thrust bearing surface geometry 74. The combination thrust and radial bearing surface consists of an elastomeric material or soft polymer. The radial bearing surface is created using a multiple (4 to 16) of circumferentially spaced flats 76 that have an enclosed circumference that is slightly larger than the outer diameter of the radial bearing profile to accommodate drill pipe and collar manufacturing tolerances (typically +/−1% of diameter). The thrust bearing portion has multiple circumferential recesses 78 that accommodate the thrust bearing ring profile, with some allowance for manufacturing tolerances and to accommodate axial expansion and contraction of the bearing material. This thrust bearing portion may also include multiple flats to provide a hydrodynamic wedge to improve thrust bearing performance. The bearing also contains a multitude of small (⅛-to-½-inch diameter) passageways 80 that allow for the flow of fluid and clearance of cuttings and debris from the interior of bearing sleeve as shown in FIG. 5.

Figure 5:
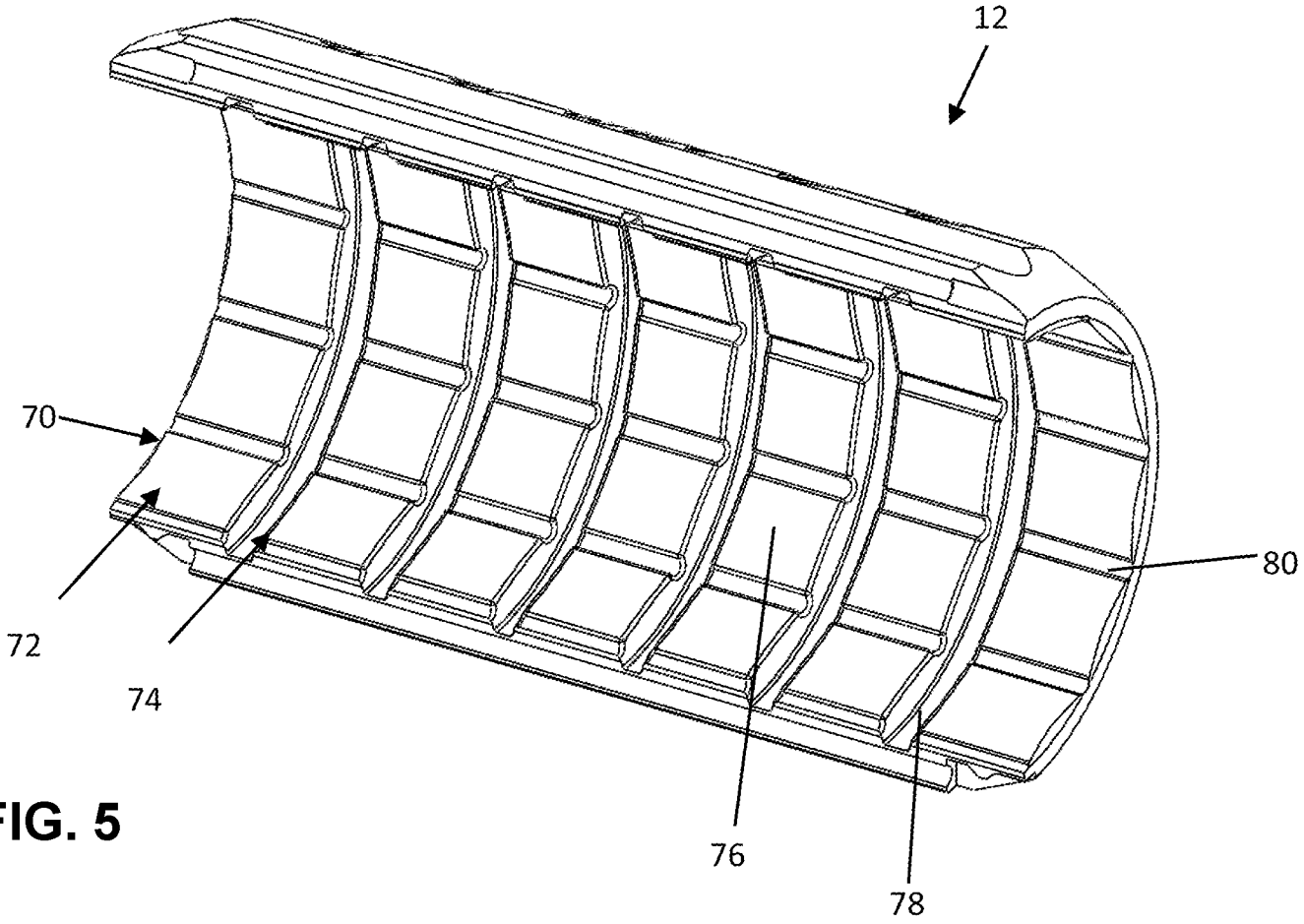
FIG. 5 is a perspective view of the sleeve that illustrates the internal geometry of the bearing sleeve.

FIG. 5 illustrates the internal geometry of the bearing sleeve with a 75° trapezoidal geometry recesses 78 for a thrust bearing ring profile, and a series of 12 equally spaced hydrodynamic bearing flats 76 with flow channels 80 axially traversing the sleeve bearing.

The retention or momentary "trapping" of the fluid within the assembly facilitates the maintenance of the fluid bearing. The sleeve extends 10-30% of the assembly diameter beyond the last circumferential ring, thereby preventing of significant amounts of drilling fluid out of the assembly that could starve the fluid bearing and reducing its efficiently.

The bearing sleeve may contain an internal structural cage 18 split axially into two pieces, with a hinge 20 on one side, and a means 22 of holding the bearing sleeve together on the other side, (pinned, bolted, etc.) as shown in FIG. 1. In the case of the dovetail sleeve, the sleeve may not require a structural cage, but may instead be placed with the sleeve locked onto the matching dovetail rings of the collar as shown in FIG. 3. As an alternate configuration, the sleeve may be made in one cylindrical piece from an elastomeric material and stretched circumferentially to enable placement around the thrust bearing rings placed around the pipe.

The sleeve is typically made of a thermoplastic or thermoset polymer, such as polyurethane, polyethylene, polypropylene, polyethylene terephthalate (PETE), polyvinyl chloride (PVC), polystyrene (PS), polylactic Acid (PLA), polycarbonate, or polytetrafluoroethylene (PTFE or Teflon), or nylon, or composites of several materials. The inner surface of the sleeve is typically of softer material than the exterior, and normally from an elastomeric material such as polyurethane or rubber. The interior of the sleeve can be of the same material as the external portion, but the interior will be softer to allow better formation of fluid bearings while the exterior will be harder to provide greater wear resistance. Alternatively, the inner surface of the sleeve can be a different material from the exterior, such as elastomer or soft plastic inner material, with a hard plastic exterior. Further alternatively, the sleeve can be constructed of a metal (steel, aluminum) and a soft (elastomeric, plastic) liner. Also, for some applications of high wear, wear pads of low friction material such as ultra-high molecular weight polyethylene (UHMW-PE) or wear resistant materials such as bronze or ceramics such as glass or aluminum oxide may be used and would be included in the exterior of the sleeve.

In one configuration, a structural cage (steel, aluminum, titanium, glass/carbon composite) can be used. In an alternative configuration, no cage is incorporated but the sleeve material is of greater structural strength and rigidity.

Circumferential grooves interfacing with thrust bearing rings in the presence of drilling fluid results in both circumferential hydraulic fluid bearing of extremely low coefficient of friction and an axial thrust hydraulic fluid bearing with extremely low coefficient of friction. The combination of two types of fluid bearing results in a substantially (10-35%) overall lower friction by the NRP of the present invention when compared to NRP with only a circumferential fluid bearing. Further, trapping or retaining fluid within the bearing between the surfaces of relative motion further damps vibration, particularly impulses.

The sleeve length is extended beyond the thrust bearing rings that effectively capture drilling fluid, creating a reservoir for development of the fluid bearing. This method is substantially better than designs that allow substantial leakage from the ends of the sleeve to the surface of previous collar designs.

The incorporation of multiple attachment bolts increases the gripping of the collar to the drill pipe. Because the attachment bolts are interior to the sleeve, the bolts and their receptacle surfaces are shielded from high velocity fluids passing the exterior of the sleeve, thereby reducing, or eliminating erosion of the attachment areas.

Because the collar can be made of a longitudinal halves extending continuously through the bearing sleeve, the gripping of the NRP has greater gripping strength than two separate collars separated by a flexible sleeve. This is especially important when the NRP is used in managed pressure drilling and passing through a rotating control device sealing element.

In the embodiment with dovetail cross sectional thrust bearing rings, a sleeve can be constructed without a cage, without significant reduction in structural integrity. Because of this embodiment, in the event of damaging and stripping of the sleeve from the collar, the subsequent drilling of the sleeve (left in the hole) is greatly facilitated because of the absence of metal. Further, it is possible that at moderate drilling mud weights, the sleeve will float to the surface in the returning annular fluid. In addition, in this embodiment the sleeve without a cage is less expensive and easier to manufacture.

The combination of the circumferential and thrust bearings can used with other useful features such as straight blades and large flutes or spiral blades. The straight blades help prevent the sleeve from rotating thereby increasing wear life; the large flutes facilitate flow by of the returning well bore fluid, thereby reducing equivalent circulating density (ECD). Spiral blades facilitate traversing from casing into open hole and the sleeve tends to rotate rather than snag a ledge. Further, by making the diameter of the sleeve greater than the diameter to the drill pipe it is attached produces a "standoff" preventing the drill pipe from wearing the casing.

The attachment of the NRP allows placement at virtually any location on the drill string. The ability to place the invention at specific locations allows the placement at locations of high side load (that results in high drilling torques and casing wear), and similarly avoid additional assemblies where they are not needed, hence reducing user costs.

The relatively light weight of the NRP does not affect overall rig safety. Because of the relatively low weight of the NRP, multiple NRPs can be placed on the string without significantly affecting the safe lifting capacity of the derrick. This is opposite to configurations that use integral subs that can add 10,000-100,000 lbs. of string weight which can approach the derrick danger loads. These and other aspects of the invention can be seen from the disclosure, however changes and modification can be made which are within the scope of the invention as hereinafter claimed.

What is claimed is:

1. A non-rotating drill pipe protector comprising a collar for attachment to a drill pipe and a sleeve positioned around the collar wherein drilling fluid passes between flexible bearing surfaces between on collar and the sleeve which generates hydrodynamic fluid bearings in both an axial and thrust direction of the drill pipe, wherein a portion of the flexible bearing surfaces on the sleeve are flats extending in a longitudinal and a circumferential direction on the inner surface of the sleeve, wherein the collar has multiple circumferential bearing rings spaced along the length of the collar, wherein the bearing rings have at least one longitudinal channel for axial flow of the drilling fluid through the protector, and wherein the longitudinal channel is circumferentially staggered between adjacent bearing rings.

2. The protector of claim 1 wherein the collar and the sleeve comprise two halves each hinged and fastened together.

3. The protector of claim 1 wherein the circumferential bearing rings have flanks, wherein the flanks of at least some adjacent bearing rings have different angle orientation relative to a longitudinal axis of the protector.

4. The protector of claim 3 wherein a flank of a first bearing ring is square shaped and a flank of a second bearing ring is trapezoidal shaped.

5. The protector of claim 1 wherein the sleeve has a plurality of circumferential grooves along an inside surface for receipt of the bearing rings of the collar.

6. The protector of claim 1 wherein the sleeve has a plurality of longitudinal blades and flutes between the blades on an exterior surface.

7. The protector of claim 6 wherein the blades are spiral.

8. The protector of claim 1 wherein the bearing rings have a square, tapered, trapezoidal or dovetail cross-section.

9. The protector of claim 1 wherein the bearing rings include fasteners to attach the collar to the drill pipe.

10. The protector of claim 1 wherein the bearing surfaces are on an inside surface of the sleeve and include multiple circumferentially spaced flat portions positioned between the circumferential grooves to produce thrust fluid bearings.

11. The protector of claim 1 wherein the bearing surfaces are on an inside surface of the sleeve and include multiple circumferential recesses for receipt of the to provide axial fluid bearings.

12. The protector of claim 10 wherein the flat portions of the bearing surfaces are circumferentially spaced from one another by passageways extending axially between the flat portions for flow of drilling fluid and clearance of cuttings and debris from between the sleeve and the collar.

13. The protector of claim 1 wherein the sleeve includes an internal structural cage.

14. The protector of claim 1 wherein a thickness of the collar between at least two adjacent bearing rings is non-uniform.

15. The protector of claim 1 wherein an inside surface of the collar has a layer of deformable material or high friction materials for gripping the drill pipe.

16. The protector of claim 1 wherein the bearing rings are axially spaced non-uniformly between adjacent bearing rings.

17. The protector of claim 1 wherein the sleeve has an inner surface of softer material than an outer surface.

18. A non-rotating drill pipe protector comprising:

a collar for attachment around a drill pipe having a plurality of axially spaced circumferential bearing rings, each bearing ring having at least one fluid flow channel extending therethrough for axial passage of drilling fluid; and a sleeve positioned around the collar having a plurality of circumferential grooves along an inside surface for receipt of the bearing rings and a plurality of flat bearing surfaces between each circumferential groove, the flat bearing surfaces are spaced circumferentially from one another by an axially extending passageway, wherein upon passage of drilling fluid between the collar and the sleeve rotational hydrodynamic fluid bearings are created at the flat bearing surfaces between each circumferential groove and axial fluid bearings are created between bearing surfaces of the bearing rings and the circumferential grooves of the sleeve.

19. The protector of claim 18 wherein the bearing rings have a square, tapered, trapezoidal or dovetail cross-sectional configuration.

* * * * *